United States Patent [19]

Da Fonte, Jr.

[11] 4,359,345

[45] Nov. 16, 1982

[54] TRIVALENT CHROMIUM PASSIVATE SOLUTION AND PROCESS

[75] Inventor: Bento Da Fonte, Jr., Mt. Clemens, Mich.

[73] Assignee: Occidental Chemical Corporation, Warren, Mich.

[21] Appl. No.: 254,699

[22] Filed: Apr. 16, 1981

[51] Int. Cl.[3] ..... C23F 9/00; C23F 7/26

[52] U.S. Cl. ..... 148/6.2; 148/6.21

[58] Field of Search ..... 148/6.2, 6.21

[56] References Cited

U.S. PATENT DOCUMENTS 4,171,231 10/1979 Bishop et al. ..... 148/6.21

*Primary Examiner*—James R. Hoffman

*Attorney, Agent, or Firm*—Richard P. Mueller

[57] ABSTRACT

An aqueous acidic solution and process for treating metal surfaces, particularly zinc and zinc alloy surfaces, to impart improved corrosion resistance thereto. The solution contains effective amounts of chromium ions substantially all of which are in the trivalent state, hydrogen ions to provide a pH of about 1.5 to about 2.2, an oxidizing agent, iron ions in combination with at least one additional metal ion selected from the group consisting of cobalt, nickel, molybdenum, manganese, lanthanum and mixtures thereof. The treating solution may optionally further contain halide ions and a wetting agent.

30 Claims, No Drawings

TRIVALENT CHROMIUM PASSIVATE SOLUTION AND PROCESS

BACKGROUND OF THE INVENTION

A variety of chromium containing aqueous solutions have heretofore been used or proposed for treating zinc, zinc alloy, cadmium and cadmium alloy surfaces for improving the corrosion resistance properties thereof and to further enhance the appearance of such surfaces by imparting a clear to a blue-bright coating thereto, the latter simulating a chromium finish. Such treating solutions originally contained chromium in the hexavalent state and in more recent years the chromium constituent was present as a mixture of the hexavalent and trivalent forms. The reduced toxicity of trivalent chromium and the increased simplicity and efficiency in treating waste effluents containing trivalent chromium has occasioned an increased commercial use of treating solutions in which the chromium constituent is substantially entirely in the trivalent state. Such prior art trivalent chromium passivating solutions have been found to be somewhat less effective than the hexavalent chromium passivate solutions in imparting good corrosion resistance to the zinc, zinc alloy, cadmium and cadmium alloy surfaces treated and there has, accordingly, been a continuing need for further improvement in trivalent chromium passivate solutions and processes.

The foregoing problem has been further aggravated by a conversion from conventional cyanide zinc and cadmium plating processes to acid and alkaline non-cyanide electroplating baths which produce metal deposits which are not as receptive to chromium passivate treatments.

Typical of prior art compositions and processes for treating zinc and zinc alloy surfaces are those disclosed in U.S. Pat. Nos. 2,393,663; 2,559,878; 3,090,710; 3,553,034; 3,755,018; 3,795,549; 3,880,772; 3,932,198; 4,126,490; 4,171,231; British Pat. Nos. 586,517 and 1,461,244; and German Pat. No. 2,526,832.

The present invention provides a treating solution and process which is effective to impart improved corrosion resistance to zinc, zinc alloy, cadmium and cadmium alloy, as well as aluminum and magnesium surfaces and to impart a desirable surface finish which can range from a clear bright to a light blue-bright appearance, which process is simple to control and operate and which is of efficient and economical operation.

SUMMARY OF THE INVENTION

The benefits and advantages of the present invention are achieved in accordance with the composition aspects thereof by providing an aqueous acidic treating solution containing as its essential constituents, chromium ions substantially all of which are present in the trivalent state at a concentration of from about 0.05 grams per liter (g/l) up to saturation, hydrogen ions to provide a solution pH of about 1.5 to about 2.2 which can be conveniently introduced by mineral acids such as sulfuric acid, nitric acid, hydrochloric acid or the like, an oxidizing agent of which hydrogen peroxide itself is preferred present in an amount of about 1 to about 20 g/l, and iron ions present in an amount of about 0.05 to about 0.5 g/l in further combination with at least one additional metal ion selected from the group consisting of cobalt, nickel, molybdenum, manganese, lanthanum and mixtures thereof present in an amount effective to activate the bath and formation of a chromium passivate film on the substrate treated. The solution may further optionally contain halide ions for imparting hardness to the coating as well as a wetting agent.

In accordance with the process aspects of the present invention, zinc, cadmium or zinc alloy or cadmium alloy surfaces are contacted with the aqueous acidic treating solution preferably at a temperature ranging from about 40° to about 150° F., preferably from about 70° to about 90° F. for a period of time typically ranging from about 10 seconds to about one minute to form the desired passivate coating thereon.

Additional benefits and advantages will become apparent on a reading of the Description of the Preferred Embodiments taken in conjunction with the examples provided.

DESCRIPTION OF THE PREFERRED EMBODIMENTS

The present invention is particularly applicable but not limited to the treatment of alkaline and acidic non-cyanide zinc electrodeposits to impart improved corrosion resistance and a decorative appearance to the treated substrate. Particularly satisfactory results are obtained on decorative zinc electrodeposits of the bright and semi-bright types although beneficial effects are also achieved on zinc and zinc alloy substrates such as galvanized substrates, zinc die castings and substrates comprised of cadmium or alloys of cadmium predominantly comprised of cadmium. While the invention as herein described is particularly directed to the treatment of zinc and zinc alloy surfaces, it has been observed that beneficial results are also obtained in the treatment of aluminum, aluminum alloy, magnesium and magnesium alloy surfaces to form a passivate film or coating thereon. Accordingly, the present invention in its broad sense is directed to the treatment of metal surfaces which are receptive to the formation of a passivate film thereon when contacted with the solution of the present invention in accordance with the process parameters disclosed.

In the case of decorative zinc electroplatings, a further enhancement of the appearance of such substrates in addition to the corrosion resistance imparted is achieved by the passivate film which ranges from a clear bright to a light blue bright appearance simulating that of a chromium deposit.

In accordance with the present invention, the treating solution contains as its essential constituents, chromium ions which are present substantially all of the trivalent state, hydrogen ions to provide a pH of from about 1.5 to about 2.2, an oxidizing agent in an amount effective to activate the hydrated trivalent chromium to form a chromate film on the metal surface, iron ions present in the operating bath in the ferric state at a concentration ranging from about 0.05 to about 0.5 grams per liter and at least one additional metal ion selected from the group consisting of cobalt, nickel, molybdenum, manganese, lanthanum and mixtures thereof present in an amount effective to impart integral hardness to the gelatinous chromate film. The treating solution may optionally further contain halide ions including fluoride, chloride and bromide ions for increasing the hardness of the passivate film as well as one or more compatible wetting agents for achieving efficient contact with the substrate being treated.

The trivalent chromium ions can be introduced in the form of any bath soluble and compatible salt such as chromium sulfate $Cr_2(SO_4)_3$, chromium alum $[KCr(SO_4)_2]$, chromium chloride $[CrCl_3]$, chromium bromide $[CrBr_3]$, chromium fluoride $[CrF_3]$, chromium nitrate $Cr(NO_3)_3$, or the like. The trivalent chromium ions can also be introduced by a reduction of a solution containing hexavalent chromium ions employing an appropriate reducing agent of any of the types well known in the art to effect a substantially complete stoichiometric reduction of all of the hexavalent chromium to the trivalent state.

The concentration of the trivalent chromium ions in the treating solution may range from as low as about 0.05 g/l up to saturation with quantities of about 0.2 to 2 g/l being preferred. Typically, the operating bath contains from about 0.5 to about 1 g/l trivalent chromium ions.

The treating bath contains hydrogen ions in an amount to provide a pH of about 1.5 to about 2.2 with a pH range of about 1.6 to about 1.8 being preferred. Acidification of the operating bath to within the desired pH range can be achieved by a variety of mineral acids and organic acids such as sulfuric acid, nitric acid, hydrochloric acid, formic acid, acetic acid, propionic acid and the like of which sulfuric acid and nitric acid are preferred. The presence of sulfate ions in the bath has been found beneficial in achieving the desired passivation of the substrate and can be introduced by the sulfuric acid addition or sulfate salts of the other bath constituents. Sulfate ion concentrations can range in amounts up to about 15 g/l with amounts of about 0.5 to about 5 g/l being preferred.

The treating bath further contains an oxidizing agent or agents which are bath compatible of which peroxides including hydrogen peroxide and metal peroxides such as the alkali metal peroxides are preferred. Hydrogen peroxide itself of a commercial grade containing about 35% by volume peroxide constitutes the preferred material. Other peroxides that can be employed include zinc peroxide. Additionally, ammonium and alkali metal persulfates have also been found effective as oxidizing agents.

The concentration of the oxidizing agent or mixture of oxidizing agents is controlled to achieve the desired surface appearance of the treated substrate which preferably is of a bright blue appearance. Typically, the concentration of the oxidizing agent can range from about 1 to about 20 g/l with an amount of about 3 to about 7 g/l being preferred calculated on a weight equivalent effectiveness basis to hydrogen peroxide.

In addition to the foregoing bath constituents, the treating solution further contains iron ions present in an amount of about 0.05 to about 0.5 g/l with concentrations ranging from about 0.1 to about 0.2 g/l being preferred. The iron ions in the operating bath are predominantly in the ferric state due to the presence of the bath oxidizing agents although they can be added in the ferrous form. As in the case of the chromium ions, the iron ions can be added to the bath in the form of any bath soluble and compatible iron salt such as ferrous ammonium sulfate, ferric sulfate, ferric nitrate, iron halide salts, and the like. Of the foregoing, ferric sulfate comprises the preferred material for economic reasons and because the use of this salt also introduces the desired sulfate ions into the solution.

In addition to the iron ions, the bath further contains at least one additional metal ion selected from the group consisting of cobalt, nickel, molybdenum, manganese, lanthanum, as well as mixtures thereof. The foregoing metal ions or mixtures of metal ions are conveniently introduced as in the case of the iron ions, by way of bath soluble and compatible metal salts including the sulfates, nitrates, halide salts, or the like. For economic reasons, the lanthanum ions are introduced not as a pure lanthanum compound, but as a mixture of the rare earth salts of the metals of the lanthanide series, (hereinafter designated as "lanthanide mixture") which contains lanthanum compounds as the predominant constituent. A commercially available lanthanide mixture which is suitable for use in the practice of the present invention is Lanthanum-Rare Earth Chloride, product code 5240, available from Molycorp, Inc. of White Plains, New York. This product has the general formula $La\text{-}RECl_3 \cdot 6H_2O$ and is available as a solution containing about 55 to 60% by weight solids. The solution is prepared from a rare earth oxide (REO) concentrate containing a minimum of 46% by weight total REO comprising about 60% lanthanum oxide ($La_2O_3$), 21.5% neodymium oxide ($Nd_2O_3$), 10% cerium oxide ($CeO_2$), 7.5% praseodymium oxide ($Pr_6O_{11}$) and 1% of residual REO. The presence of such other rare earth metals in the solution does not appear to have any adverse effect at the low concentrations in which they are present and may further contribute to the activation of the treating solution in forming the passivate film.

The concentration of the additional metal ions for appropriate activation of the treating bath is controlled to provide a concentration ranging from about 0.02 up to about 1 g/l with concentrations of from about 0.1 to about 0.2 g/l being preferred.

As an optional but preferred constituent, the bath contains halide ions including chlorine, bromine and fluorine ions which have been found to enhance the hardness of the passivate film on the treated substrate. The halide ions or mixture thereof can conveniently be introduced employing any of the alkali metal and ammonium salts thereof as well as salts of the metal ions hereinabove set forth. The concentration of the total halide constituent in the bath normally may range up to about 2 grams per liter with concentrations of about 0.1 to about 0.5 g/l being typical.

In addition to the foregoing, the use of a small effective amount of a variety of bath compatible wetting agents also provides beneficial results in the nature of the passivate film deposited. When employed the wetting agent can be present in concentrations up to about 1 gram per liter (g/l) with concentrations of about 50 to about 100 mg/l being preferred. Wetting agents suitable for use in the treating bath include aliphatic fluorocarbon sulfonates available from 3M under the Fluorad brandname, such as, for example, Fluorad FC 98, which is a nonfoaming wetting agent and its use at about 100 mg/l in the working bath improves the color and hardness of the passivate film. A second class of suitable wetting agents is the sulfo derivatives of succinates. An example of this class is Aerosol MA-80 which is a dihexyl ester of sodium sulfosuccinic acid and is commercially available from American Cyanamid Company. A third class of suitable wetting agents is the sulfonates of napthalene which are linear alkyl napthalene sulfonates, such as Petro BA, for example, available from Petrochemical Company.

In accordance with the process aspects of the present invention, a treating bath formulation as hereinabove described is applied to a substrate to be treated by spray, immersion, flooding or the like for a period of time sufficient to form the desired passivate film thereon.

The treating solution is preferably controlled within a temperature range of about 40° to about 150° F., with about 70° to about 90° F. being preferred. Temperatures above about 90° F. have a tendency to cause a rapid loss of peroxide-type oxidizing agents when used whereas temperatures below about 70° F. reduce the activity of the bath requiring increased contact times to achieve a passivate film on the same thickness or color intensity as can be achieved at the higher temperatures at shorter time intervals. Typically, contact times of about 20 seconds to about 1 minute are satisfactory with contact times of about 30 seconds being usually preferred.

The operating bath can be conveniently prepared by employing a concentrate containing the active constituents with the exception of the oxidizing agent which is adapted to be diluted with water to form a bath containing the constituents within the desired concentration range. Similarly, replenishment of the bath on a continuous or intermittent basis can be achieved employing a concentrate of the active constituents with the exception of the oxidizing agent which is added separately to the operating bath. Typically, a bath make-up concentrate can contain from about 10 to about 30 g/l chromium ions, about 0.5 to about 10 g/l iron ions, from about 5 to about 50 g/l of at least one additional metal ion of the group consisting of cobalt, nickel, molybdenum, manganese, lanthanum, lanthanide mixture or mixtures thereof, halide ions up to about 20 g/l and a suitable surfactant in an amount up to about 5 g/l if employed. Such a make-up concentrate is adapted to be diluted with about 98.5 volume percent water to produce an operating bath containing the active constituents within the ranges specified. The oxidizing agent such as hydrogen peroxide, for example, is separately introduced into the bath preferably in a form commercially available containing from about 35 to 40 percent by volume hydrogen peroxide.

In order to further illustrate the present invention, the following examples are provided. It will be understood that the examples are provided for illustrative purposes and are not intended to be limiting of the scope of the invention as herein disclosed and as set forth in the subjoined claims.

EXAMPLE 1

An operating bath is prepared containing:

| Ingredient | Concentration, g/l |
|---|---|
| $Cr_2(SO_4)_3$ | 2.2 |
| $NH_4HF_2$ | .18 |
| $H_2SO_4$ | 1.2 |
| $H_2O_2$ | 5.3 |
| $FeNH_4SO_4$* | 0.25 |
| $CoSO_4.7H_2O$ | 1.6 |

*Ferrous Ammonium Sulfate = $Fe(SO_4).(NH_4)_2SO_4.6H_2O$

Steel test panels are subjected to an alkaline, non-cyanide electoplating step to deposit a zinc plating thereon after which they are thoroughly water rinsed and immersed with agitation in the operating bath for a period of 20 seconds. At the conclusion of the treatment, the passivated panels are warm water rinsed, and air dried. An inspection of the coating on the panels after drying reveals an exceptionally bright clear-bluish coloration with no haziness. Additionally, the coating exhibits the appearance of a bright nickel-chromium electroplating and also exhibits excellent smear resistance on light finger-rubbing.

EXAMPLE 2

An operating bath is prepared containing:

| Ingredient | Concentration, g/l |
|---|---|
| $Cr_2(SO_4)_3$ | 5.6 |
| $NH_4HF_2$ | 0.4 |
| $H_2SO_4$ | 2.7 |
| $H_2O_2$ | 5.3 |
| $FeNH_4SO_4$ | 0.58 |
| $CoSO_4.7H_2O$ | 3.75 |

The operating bath of Example 2 is similar to that of Example 1 with the exception that the trivalent chromium, ammonium bifluoride, sulfuric acid, iron and cobalt constituents are of a higher concentration. The zinc plated test panels treated with the bath of Example 2 produced results substantially equivalent to those obtained with the operating bath of Example 1.

EXAMPLE 3

An operating bath is prepared containing:

| Ingredient | Concentration, g/l |
|---|---|
| $Cr_2(SO_4)_3$ | 3.0 |
| $NH_4HF_2$ | 0.24 |
| $H_2SO_4$ | 1.54 |
| $H_2O_2$ | 5.3 |
| $FeNH_4SO_4$ | 0.25 |
| $NiNH_4SO_4$* | 2.1 |

*Nickel Ammonium Sulfate = $NiSO_4.(NH_4)_2SO_4.6H_2O$

The zinc plated test panel treated with this operating bath under the same conditions as described in Example 1 was observed, after drying, to have a coating which is very bright with a clear bluish coloration and no haziness. The coating also exhibits good smear resistance on light finger rubbing.

EXAMPLE 4

An operating bath is prepared identical to that as set forth in Example 3 with the exception that 1.6 g/l of nickel sulfate is employed in place of 2.1 g/l of nickel ammonium sulfate. The zinc plated test panels treated in a manner as previously described in Example 1 employing the treating solution of Example 4 produced results substantially comparable to those obtained with the treating bath of Example 3 except that the coating has a slightly less bluish coloration.

EXAMPLE 5

A series of test solutions are prepared for treating zinc plated steel test panels to evaluate their relative corrosion resistance to a 5 percent neutral salt spray. The composition of the test solutions 5A, 5B, 5C and 5D are as follows:

| | Concentration, g/l | | | |
|---|---|---|---|---|
| Ingredient | 5A | 5B | 5C | 5D |
| $Cr_2(SO_4)_3$ | 3.0 | 3.0 | 3.0 | 3.0 |
| $NH_4HF_2$ | 0.24 | 0.24 | 0.24 | 0.24 |
| $H_2SO_4$ | 1.54 | 1.54 | 1.54 | 1.54 |
| $H_2O_2$ | 5.3 | 5.3 | 5.3 | 5.3 |
| $FeNH_4SO_4$ | — | 0.25 | 0.25 | 0.25 |
| $CoSO_3$ | — | — | 1.6 | — |
| $NiNH_4SO_4$ | — | — | — | 2.1 |

Test solution 5A contains only trivalent chromium ions; test solution 5B additionally contains ferrous ions; test solution 5C contains a combination of iron and cobalt ions while test solution 5D contains a combination of iron and nickel ions.

In addition to the foregoing operating test solutions, a traditional hexavalent chromium passivating solution is prepared to serve as a control containing 0.63 g/l sodium dichromate, 0.63 g/l ammonium bifluoride, 0.01 g/l sulfuric acid, 0.65 g/l nitric acid. This solution is designated as test solution 5E.

Duplicate sets of 3 inch by 4 inch steel panels are cleaned and zinc plated using a non-cyanide zinc plating electrolyte for fifteen minutes at a plating current density of 20 amperes per square foot (ASF), whereafter they are thoroughly rinsed. Each set of zinc plated test panels thereafter is immersed in the respective treating solution for a period of twenty seconds whereafter they are warm water rinsed, air-dried and thereafter allowed to age twenty-four hours prior to salt spray testing in accordance with ASTM standards. The test panels are subjected to the five percent neutral salt spray for a total of forty-three hours. For further comparative purposes, a duplicate set of zinc test panels without any passivation treatment is also subjected to the neutral salt spray test. The results are set forth in Table 1.

TABLE 1

NEUTRAL SALT SPRAY TEST RESULTS

| TEST PANEL | PERCENT WHITE CORROSION, % | PERCENT RED RUST, % |
|---|---|---|
| Untreated | 50 | 50% |
| 5A | 45–55 | 0 |
| 5B | 10–15 | 0 |
| 5C | less than 2 | 0 |
| 5D | less than 10 | 0 |
| 5E | 45–55 | 0 |

Based on the foregoing test results it is apparent that the untreated zinc plated test panel is a gross failure; the test panel treated with solution 5A is a failure; the test panels treated with solution 5B are a marginal pass; the test panels treated with solutions 5C and 5D pass the test; and the test panel treated with solution 5E is a failure.

EXAMPLE 6

An operating bath is prepared containing:

| Ingredient | Concentration, g/l |
|---|---|
| $Cr_2(SO_4)_3$ | 3.0 |
| $NH_4HF_2$ | 0.24 |
| $H_2SO_4$ | 1.54 |
| $FeNH_4SO_4$ | 0.24 |
| $H_2O_2$ | 5.3 |
| $MnSO_4.H_2O$ | 1.0 |

Electroplated zinc test panels prepared in accordance with the procedure as set forth in Example 5 are immersed in the bath of Example 6 for a period of 30 seconds, warm water rinsed, air dried and allowed to age 24 hours prior to 5 percent neutral salt spray testing. For comparative purposes, zinc test panels are treated with the solutions 5A and 5E of Example 5 and subjected to the same salt spray evaluation.

After 48 hours salt spray, an inspection of the several test panels reveals that the panels treated with the solution of Example 6 have superior corrosion resistance to that of the panels treated with solutions 5A and 5E.

EXAMPLE 7

An operating bath is prepared containing:

| Ingredient | Concentration, g/l |
|---|---|
| $Cr_2(SO_4)_3$ | 3.0 |
| $NH_4HF_2$ | 0.24 |
| $H_2SO_4$ | 1.54 |
| $FeNH_4SO_4$ | 0.24 |
| $H_2O_2$ | 5.3 |
| $H_2MoO_4.H_2O$ | 1.0 |

Electroplated zinc test panels prepared in accordance with Example 5 are immersed in the bath of Example 7 for a period of 30 seconds, warm water rinsed, air dried and allowed to age 24 hours prior to 5 percent neutral salt spray testing. For comparative purposes, zinc test panels are treated with the solutions 5A and 5E of Example 5 and subjected to the same salt spray evaluation.

After 48 hours of salt spray test, an inspection of the panels reveals that the panels treated with the solution of Example 7 have superior corrosion resistance in comparison to that of the test panels treated with solutions 5A and 5E.

EXAMPLE 8

An operating bath is prepared containing:

| Ingredient | Concentration, g/l |
|---|---|
| $Cr_2(SO_4)_3$ | 3.0 |
| $NH_4HF_2$ | 0.24 |
| $H_2SO_4$ | 1.54 |
| $FeNH_4SO_4$ | 0.24 |
| $H_2O_2$ | 5.3 |
| $(NH_4)_4(NiMoO_{24}H_6)_4.4H_2O$ | 1.0 |

Electroplated zinc test panels prepared in accordance with the procedure described in Example 5 are immersed in the bath of Example 8 for a period of 30 seconds, warm water rinsed, air dried and allowed to age 24 hours prior to a 5 percent neutral salt spray test. For comparative purposes, zinc test panels are treated with the solutions 5A and 5E of Example 5 and subjected to the same salt spray evaluation.

After 48 hours salt spray, an inspection of the panels reveals that the panels treated with the solution of Example 8 had superior corrosion resistance in comparison to the panels treated with solutions 5A and 5E.

A relative comparison of the test panels prepared in accordance with Examples 6, 7 and 8 reveals that the solution of Example 7 containing iron ions and Molybdic acid and the solution of Example 8 containing iron ions in combination with ammonium 6-molybdonickelate possessed superior corrosion resistance to the test panels treated with the operating solution of Example 6 containing iron ions in combination with manganese ions. The test panels treated in accordance with Example 7 and 8 also possessed superior corrosion resistance to test panels treated with the test solution 5B of Example 5 containing only iron ions whereas the test panels treated with the solution of Example 6 containing both iron and manganese ions possess corrosion resistance somewhat comparable to that of panels treated with solution 5B.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. An aqueous acidic solution for treating receptive metal substrates to impart a chromate passivate film thereon comprising chromium ions substantially all of which are in the trivalent state, an acid, a solution compatible peroxide or persulfate oxidizing agent, iron ions in combination with at least one additional metal ion selected from the group consisting of cobalt, nickel, molybdenum, manganese, lanthanum, lanthanide mixture and mixtures thereof present in an effective amount to impart increased corrosion resistance to the treated substrate.

2. The aqueous solution as defined in claim 1 in which the trivalent chromium ions are present in an amount of about 0.05 g/l up to saturation.

3. The aqueous acidic solution as defined in claim 1 in which the trivalent chromium ions are present in an amount of about 0.2 to about 2 g/l.

4. The aqueous solution as defined in claim 1 in which the trivalent chromium ions are present in an amount of about 0.5 to about 1 g/l.

5. The aqueous solution as defined in claim 1 having a pH of about 1.5 to about 2.2.

6. The aqueous solution as defined in claim 1 having a pH of about 1.6 to about 1.8.

7. The aqueous solution as defined in claim 1 in which said acid is a mineral acid selected from the group consisting of sulfuric, nitric, hydrochloric and mixtures thereof.

8. The aqueous solution as defined in claim 1 in which said oxidizing agent is present in an amount of about 1 to 20 g/l calculated on a weight equivalent effectiveness basis to hydrogen peroxide.

9. The aqueous solution as defined in claim 1 in which said oxidizing agent is present in an amount of about 3 to about 7 g/l calculated on a weight equivalent effectiveness basis to hydrogen peroxide.

10. The aqueous solution as defined in claim 1 in which said oxidizing agent comprises a peroxide.

11. The aqueous solution as defined in claim 1 in which said oxidizing agent comprises hydrogen peroxide.

12. The aqueous solution as defined in claim 1 in which said iron ions are present in an amount of about 0.05 to about 0.5 g/l.

13. The aqueous solution as defined in claim 1 in which said iron ions are present in an amount of about 0.1 to about 0.2 g/l.

14. The aqueous solution as defined in claim 1 in which said one additional metal ion and mixtures thereof is present in an amount of about 0.02 to about 1 g/l.

15. The aqueous solution as defined in claim 1 in which said one additional metal ion or mixtures thereof is present in an amount of about 0.1 to about 0.2 g/l.

16. The aqueous solution as defined in claim 1 in which said one additional metal ion comprises cobalt.

17. The aqueous solution as defined in claim 1 in which said one additional metal ion comprises nickel.

18. The aqueous solution as defined in claim 1 in which said one additional metal ion comprises molybdenum.

19. The aqueous solution as defined in claim 1 in which said one additional metal ion comprises manganese.

20. The aqueous solution as defined in claim 1 in which said one additional metal ion comprises lanthanum.

21. The aqueous solution as defined in claim 1 in which said one additional metal ion comprises a lanthanide mixture comprised predominantly of lanthanum compounds.

22. The aqueous solution as defined in claim 1 further including halide ions.

23. The aqueous solution as defined in claim 22 in which said halide ions are present in an amount up to about 2 g/l.

24. The aqueous solution as defined in claim 22 in which said halide ions are present in an amount of about 0.1 to 0.5 g/l.

25. The aqueous solution as defined in claim 1 further containing a surfactant.

26. The aqueous solution as defined in claim 25 in which said surfactant is present in an amount up to about 1 g/l.

27. The aqueous solution as defined in claim 25 in which said surfactant is present in an amount of about 50 to about 100 mg/l.

28. The aqueous solution as defined in claim 1 further containing sulfate ions in an amount up to about 15 g/l.

29. The aqueous solution as defined in claim 1 further containing sulfate ions in an amount of about 0.5 to about 5 g/l.

30. A process for treating a receptive metal substrate to impart a chromate passivate film thereon which comprises the steps of contacting the substrate with a solution at a temperature of about 40° to about 150° F. having a composition of claim 1 or 2 or 3 or 4 or 5 or 6 or 7 or 8 or 9 or 10 or 11 or 12 or 13 or 14 or 15 or 16 or 17 or 18 or 19 or 20 or 21 or 22 or 23 or 24 or 25 or 26 or 27 or 28 or 29 for a period of time sufficient to form a passivate film thereon.

* * * * *